US011420779B2

(12) United States Patent
Sugiura

(10) Patent No.: US 11,420,779 B2
(45) Date of Patent: Aug. 23, 2022

(54) PACKAGING METHOD USED IN BAG-FEEDING AND PACKAGING APPARATUS, AND THE BAG-FEEDING AND PACKAGING APPARATUS

(71) Applicant: General Packer Co., Ltd., Kitanagoya (JP)

(72) Inventor: Masaya Sugiura, Kitanagoya (JP)

(73) Assignee: General Packer Co., Ltd., Kitanagoya (JP)

( * ) Notice: Subject to any disclaimer, the term of this patent is extended or adjusted under 35 U.S.C. 154(b) by 136 days.

(21) Appl. No.: 16/496,731

(22) PCT Filed: Apr. 5, 2017

(86) PCT No.: PCT/JP2017/014217
§ 371 (c)(1),
(2) Date: Sep. 23, 2019

(87) PCT Pub. No.: WO2018/185873
PCT Pub. Date: Oct. 11, 2018

(65) Prior Publication Data

US 2020/0031505 A1 Jan. 30, 2020

(51) Int. Cl.
*B65B 1/04* (2006.01)
*B65B 3/04* (2006.01)
(Continued)

(52) U.S. Cl.
CPC ..... *B65B 3/04* (2013.01); *B65B 1/04* (2013.01); *B65B 43/30* (2013.01); *B65B 43/465* (2013.01)

(58) Field of Classification Search
CPC ..... B65B 43/30; B65B 43/465; B65B 59/02
(Continued)

(56) References Cited

U.S. PATENT DOCUMENTS 3,982,376 A * 9/1976 Ikeda ..... B65B 43/30 53/53
4,169,345 A * 10/1979 Douwenga ..... B65B 43/267 53/570
(Continued)

FOREIGN PATENT DOCUMENTS

EP 1832517 A1 9/2007
JP S56-106702 A 8/1981
(Continued)

OTHER PUBLICATIONS

Notification of Reasons for Refusal for the corresponding JP patent application No. 2019-510556 dated Aug. 28, 2020 and English translation thereof.
(Continued)

*Primary Examiner* — Thanh K Truong
*Assistant Examiner* — Patrick B Fry
(74) *Attorney, Agent, or Firm* — Muncy, Geissler, Olds & Lowe, P.C.

(57) ABSTRACT

[Problem] Providing a packaging method used in a bag-feeding and packaging apparatus, which can realize speed-up of the bag-feeding and packaging apparatus without limitation of movement acceleration due to the spilling or scattering of an article during movement and which can realize a larger amount of packaging in a short time, and the bag-feeding and packaging apparatus implementing the packaging method.
[Overcoming Means] In the packaging method used in a bag-feeding and packaging apparatus P in accordance with the present invention, packaging processes are performed while a packaging bag F is intermittently moved to packaging stations 1 to 9 together with a mover 32, so that an article is packaged, and the packaging stations 1 to 9 include an article (a fluid) filling station 5 where an article filling process of filling the packaging bag with the article is
(Continued)

performed. In the article filling station 5, a bag mouth of the packaging bag F is closed before movement to a subsequent packaging station (a steam deaeration/seal part preheating station) 6 after the article filling process has been performed.

17 Claims, 14 Drawing Sheets

(51) Int. Cl.
*B65B 43/30* (2006.01)
*B65B 43/46* (2006.01)

(58) Field of Classification Search
USPC ..... 53/459, 468, 469, 284.7, 267
See application file for complete search history.

(56) References Cited

U.S. PATENT DOCUMENTS

| | | | | |
|---|---|---|---|---|
| 6,691,389 | B1 | 2/2004 | Topfer | |
| 8,122,684 | B2 * | 2/2012 | Kurz | B65B 43/465 53/284.7 |
| 8,151,543 | B2 * | 4/2012 | Veix | B65B 43/465 53/64 |
| 8,245,484 | B2 * | 8/2012 | Yamamoto | B65B 3/06 53/75 |
| 8,245,485 | B2 * | 8/2012 | Fukeda | B29C 66/232 53/95 |
| 9,957,069 | B2 * | 5/2018 | Ishikawa | B65B 31/00 |
| 9,988,167 | B2 * | 6/2018 | Murray | B65G 29/00 |
| 10,293,966 | B2 * | 5/2019 | Garriga Jimenez | B65B 43/04 |
| 2007/0204570 | A1 | 9/2007 | Okazaki | |
| 2009/0158694 | A1 * | 6/2009 | Matheyka | B65B 43/30 53/468 |
| 2010/0192524 | A1 * | 8/2010 | Rapparini | B65B 43/60 53/512 |
| 2012/0240531 | A1 * | 9/2012 | Kawamura | B65B 39/12 53/572 |
| 2014/0331603 | A1 * | 11/2014 | Takahashi | B65B 31/06 53/408 |
| 2016/0122063 | A1 | 5/2016 | Garriga Jimenez et al. | |

FOREIGN PATENT DOCUMENTS

| | | | |
|---|---|---|---|
| JP | 2010-247851 | A | 11/2010 |
| JP | 2012-180106 | A | 9/2012 |
| JP | 5266446 | B2 | 8/2013 |
| JP | 2014-118157 | A | 6/2014 |
| JP | 2014-218280 | A | 11/2014 |
| RU | 2228890 | C2 | 5/2004 |
| RU | 2588187 | C2 | 6/2016 |
| WO | 0133970 | A1 | 5/2001 |
| WO | 2013050203 | A1 | 4/2013 |

OTHER PUBLICATIONS

The extended European search report of the corresponding EP patent application No. 17904812.9 dated Oct. 30, 2020.
The Office Action of the corresponding JP application No. 2019-510556 dated Feb. 2, 2021 and English translation thereof.
Office action of the corresponding RU patent application No. 2019131854 dated May 27, 2020 and English translation thereof.
International Search Report of PCT/JP2017/014217 dated Jun. 27, 2017 and English Translation thereof.
Written Opinion of PCT/JP2017/014217 dated Jun. 27, 2017.
Written Opinion of PCT/JP2017/014217 dated Jun. 27, 2017 and English Translation thereof.

* cited by examiner

PACKAGING METHOD USED IN BAG-FEEDING AND PACKAGING APPARATUS, AND THE BAG-FEEDING AND PACKAGING APPARATUS

TECHNICAL FIELD

The present invention relates to a packaging method used in a bag-feeding and packaging apparatus which fills a packaging bag with an article to be packaged, such as food, and thereafter seals a bag mouth for the purpose of mass-production of the articles, and the bag-feeding and packaging apparatus for implementing the packaging method.

BACKGROUND ART

A bag-feeding and packaging apparatus has conventionally been used frequently which intermittently moves a packaging bag together with a mover to each packaging station to perform each packaging process, thereby packaging the article. In such a bag-feeding and packaging apparatus, when the article is liquid and acceleration during movement to a subsequent packaging station exceeds about 10 $m/S^2$, the article drips or scatters during the movement. Therefore, the movement acceleration cannot be increased to about 10 $m/S^2$ or more.

More specifically, in the conventional bag-feeding and packaging machine, for example, a filling funnel 86 is inserted through a bag mouth of a packaging bag F with grip pairs 81 respectively holding vicinities of both sides of the packaging bag so that the packaging bag F is filled with the article, as illustrated in FIG. 12A, and the packaging bag F is moved with the bag mouth being open as illustrated in FIG. 12B, and the bag mouth of the packaging bag F is closed during movement to a subsequent packaging station as illustrated in FIG. 12C.

Furthermore, when the bag mouth of the packaging bag F is required to be re-opened in or after the subsequent packaging station (for example, deaerating the packaging bag with steam, blowing off powder adherent to an inner surface of the bag mouth in the case where the article is powder, or the like), the filling funnel 86 is inserted through the bag mouth of the packaging bag F with the paired grips 81 respectively holding the vicinities of both sides of the packaging bag F so that the packaging bag F is filled with the article, as illustrated in FIG. 13A, and the packaging bag F is moved with the bag mouth being open as illustrated in FIG. 13B, and deaeration with steam is performed in the subsequent packaging station (a steam deaeration station) with the bag mouth of the packaging bag F being kept closed, as illustrated in FIG. 13D. Therefore, since the article spills or scatters during the movement to the subsequent packaging station, the movement acceleration is limited with the result of interference with speed-up of the apparatus.

PRIOR ART DOCUMENT

Patent Documents

Patent Document 1: Japanese Patent No. 5266446

SUMMARY OF THE INVENTION

Problem to be Overcome by the Invention

An object of the present invention is to provide a packaging method used in a bag-feeding and packaging apparatus, which can realize speed-up of the bag-feeding and packaging apparatus without limitation of movement acceleration due to the spilling or scattering of the article during the movement, and the bag-feeding and packaging apparatus implementing the packaging method.

Means for Overcoming the Problem

A solution to overcome the aforementioned problem is a packaging method used in a bag-feeding and packaging apparatus which performs packaging processes while intermittently moving a packaging bag to packaging stations together with a mover, thereby packaging an article. In the packaging method, a bag mouth of the packaging bag is closed before movement to a subsequent packaging station after an article filling process of filling the packaging bag with the article has been performed in an article filling station out of the packaging stations. In an article filling station where an article filling process of filling the packaging bag with the article is performed, a bag mouth of the packaging bag is closed before movement of the packaging bag to a subsequent packaging station after the article filling process has been performed. The article filling station is included in the packaging stations.

In the packaging method, when any one of the packaging stations located downstream of the article filling station has a packaging process requiring opening of the bag mouth of the packaging bag, the packaging process requiring opening of the bag mouth of the packaging bag is preferably performed after the bag mouth of the packaging bag has been closed in the packaging station where the packaging process requiring opening of the bag mouth of the packaging bag is performed, and the bag mouth of the packaging bag is preferably closed before movement of the packaging bag to a subsequent packaging station. The packaging process requiring opening of the bag mouth of the packaging bag may be a steam deaeration process of introducing steam through the bag mouth of the packaging bag to deaerate the packaging bag. A steam deaeration process of introducing steam through the bag mouth of the packaging bag to deaerate the packaging bag is preferably performed in the article filling station. The article filling process and the steam deaeration process are preferably performed concurrently in the article filling station. The steam deaeration process may be performed in the article filling station after execution of the article filling process.

The solution to overcome the aforementioned problem is also a bag-feeding and packaging apparatus which performs packaging processes while intermittently moving a packaging bag to packaging stations together with a mover, thereby packaging an article. The bag-feeding and packaging apparatus includes a bag mouth opening-closing mechanism for opening and closing a bag mouth of the packaging bag. In an article filling station where an article filling process of filling the packaging bag with the article is performed, the bag mouth opening-closing mechanism is configured to close the bag mouth of the packaging bag before movement of the packaging bag to a subsequent packaging station after the article filling process has been performed. The article filling station is included in the packaging stations.

When a packaging process requiring opening of the bag mouth of the packaging bag is performed in any one of the packaging stations located downstream of the article filling station, the packaging process requiring opening of the bag mouth of the packaging bag is preferably performed in the packaging station where the packaging process requiring opening of the bag mouth of the packaging bag is performed, after the bag mouth of the packaging bag has been opened by the bag mouth opening-closing mechanism, and the bag mouth opening-closing mechanism is preferably configured to close the bag mouth of the packaging bag before movement of the packaging bag to a subsequent packaging station. The packaging process requiring opening of the bag mouth of the packaging bag may be a steam deaeration process of introducing steam through the bag mouth of the packaging bag to deaerate the packaging bag. A steam deaeration process of introducing steam through the bag mouth of the packaging bag to deaerate the packaging bag is preferably performed in the article filling station. The article filling process and the steam deaeration process are preferably performed concurrently in the article filling station. The steam deaeration process may be performed in the article filling station after execution of the article filling process. The bag-feeding packaging apparatus preferably further includes a grip pair intermittently moved to the packaging stations together with the mover while holding vicinities of both sides of the bag mouth of the packaging bag. The bag mouth opening-closing mechanism preferably has a grip width adjusting mechanism capable of adjusting a width between the paired grips and suckers suctioning the packaging bag held by the grip pair respectively from a front and a back of the packaging bag.

Effect of the Invention

According to the packaging method used in the bag-feeding and packaging apparatus, as claimed in claim 1, since the bag mouth of the packaging bag is closed during the movement, speed-up of the bag-feeding and packaging apparatus can be realized without spilling and/or scattering of the article during the movement and without limitation of the movement acceleration due to the spilling and/or scattering of the article during the movement, with the result that a larger amount of packaging can be realized in a short time. According to the packaging method used in the bag-feeding and packaging apparatus, as claimed in claim 2, even when any one of the packaging stations located downstream of the article filling station has a packaging process requiring opening of the bag mouth of the packaging bag, speed-up of the bag-feeding and packaging apparatus can be realized without spilling and/or scattering of the article during the movement and without limitation of the movement acceleration due to the spilling and/or scattering of the article during the movement, with the result that a larger amount of packaging can be realized in a short time. According to the packaging method used in the bag-feeding and packaging apparatus as claimed in claim 3, speed-up of the bag-feeding and packaging apparatus can be realized without limitation of the movement acceleration due to the spilling and/or scattering of the article during the movement, with the result that a larger amount of packaging can be realized in a short time. According to the packaging method used in the bag-feeding and packaging apparatus, as claimed in claim 4, a packaging station where steam deaeration is performed can be eliminated with the result that speed-up of the bag-feeding and packaging apparatus can be realized and a larger amount of packaging can be realized in a shorter time. According to the packaging method used in the bag-feeding and packaging apparatus, as claimed in claim 5, since the filling of the packaging bag with the article and the steam deaeration are performed concurrently, speed-up of the bag-feeding and packaging apparatus can be realized and a larger amount of packaging can be realized in a shorter time. According to the packaging method used in the bag-feeding and packaging apparatus, as claimed in claim 6, a packaging station where steam deaeration is performed can be eliminated with the result that further speed-up of the bag-feeding and packaging apparatus can be realized and a larger amount of packaging can be realized in a shorter time. According to the bag-feeding and packaging apparatus as claimed in claim 7, since the bag mouth of the packaging bag is closed during movement, speed-up of the bag-feeding and packaging apparatus can be realized without spilling and/or scattering of the article during the movement and without limitation of the movement acceleration due to the spilling and/or scattering of the article during the movement, with the result that a larger amount of packaging can be realized in a short time. According to the bag-feeding and packaging apparatus as claimed in claim 8, even when any one of the packaging stations located downstream of the article filling station has a packaging process requiring opening of the bag mouth of the packaging bag, speed-up of the bag-feeding and packaging apparatus can be realized without spilling and/or scattering of the article during the movement and without limitation of the movement acceleration due to the spilling and/or scattering of the article during the movement, with the result that a larger amount of packaging can be realized in a short time. According to the bag-feeding and packaging apparatus as claimed in claim 9, when retort food for which steam deaeration is performed is mass-produced, for example, speed-up of the bag-feeding and packaging apparatus can be realized without limitation of the movement acceleration due to the spilling and/or scattering of the article during the movement, with the result that a larger amount of packaging can be realized in a short time. According to the bag-feeding and packaging apparatus as claimed in claim 10, a packaging station where steam deaeration is performed can be eliminated with the result that further speed-up of the bag-feeding and packaging apparatus can be realized and a larger amount of packaging can be realized in a shorter time. According to the bag-feeding and packaging apparatus as claimed in claim 11, since the filling of the packaging bag with the article and the steam deaeration are performed concurrently, speed-up of the bag-feeding and packaging apparatus can be realized and a larger amount of packaging can be realized in a shorter time. According to the bag-feeding and packaging apparatus as claimed in claim 12, a packaging station where steam deaeration is performed can be eliminated with the result that further speed-up of the bag-feeding and packaging apparatus can be realized and a larger amount of packaging can be realized in a shorter time. According to the bag-feeding and packaging apparatus as claimed in claim 13, the structure of intermittently moving the packaging bag to the packaging stations together with the mover can be realized in a simple configuration. According to the bag-feeding and packaging apparatus as claimed in claim 14, the bag mouth opening-closing mechanism can be realized with a simpler configuration.

BEST MODE FOR CARRYING OUT THE INVENTION

In the present invention, a bag-feeding and packaging apparatus P intermittently moves a packaging bag F together with a mover 32 to packaging stations 1 to 9 to perform packaging processes, thereby packaging an article. In the bag-feeding and packaging apparatus P, an article (a fluid) filling station 5 where an article filling process is performed is included in packaging stations 1 to 9. In the article filling station 5, a bag mouth of the packaging bag F is closed before movement of the packaging bag F to a subsequent packaging station (steam deaeration/seal part preheating station) 6 after the article filling process has been performed, so that the bag mouth of the packaging bag F is closed during the movement. This can realize speed-up of the bag-feeding and packaging apparatus P without the spilling and scattering of the article and without limitation of the movement acceleration due to the spilling and scattering of the article during the movement, with a result that a larger amount of packaging can be realized in a short time.

Embodiments

The packaging method used in the bag-feeding and packaging apparatus in accordance with the present invention will be described with reference to an embodiment shown in FIGS. 1A to 4. In the embodiment, the packaging method used in the bag-feeding and packaging apparatus is used in a bag-feeding and packaging apparatus P which intermittently moves a packaging bag F together with a mover (a disk-shaped rotator) 32 to packaging stations 1 to 9 to perform packaging processes, thereby packaging an article. The packaging method used in the bag-feeding and packaging apparatus P is characterized in that after a filling process of filling a packaging bag F with an article (a fluid) has been performed in a filling station 5 out of packaging stations 1 to 9, a bag mouth of the packaging bag F is closed before the packaging bag F is moved to a subsequent packaging station (steam deaeration/seal part preheating station) 6. The construction of the bag-feeding and packaging apparatus P and the packaging method used in the bag-feeding and packaging apparatus P will hereinafter be described in detail.

The bag-feeding and packaging apparatus P of this embodiment is a rotary type bag-feeding and packaging apparatus which intermittently moves the packaging bag F together with the mover (the disk-shaped rotator) 32 to the packaging stations 1 to 9 with grip pairs 31 respectively holding the vicinities of both sides of the packaging bag F so that the packaging bag F is filled with the article, thereby packaging the article. The bag-feeding and packaging apparatus P has four grip pairs 31 which are intermittently moved to the packaging stations 1 to 9 in a concurrent manner.

Figure 1:
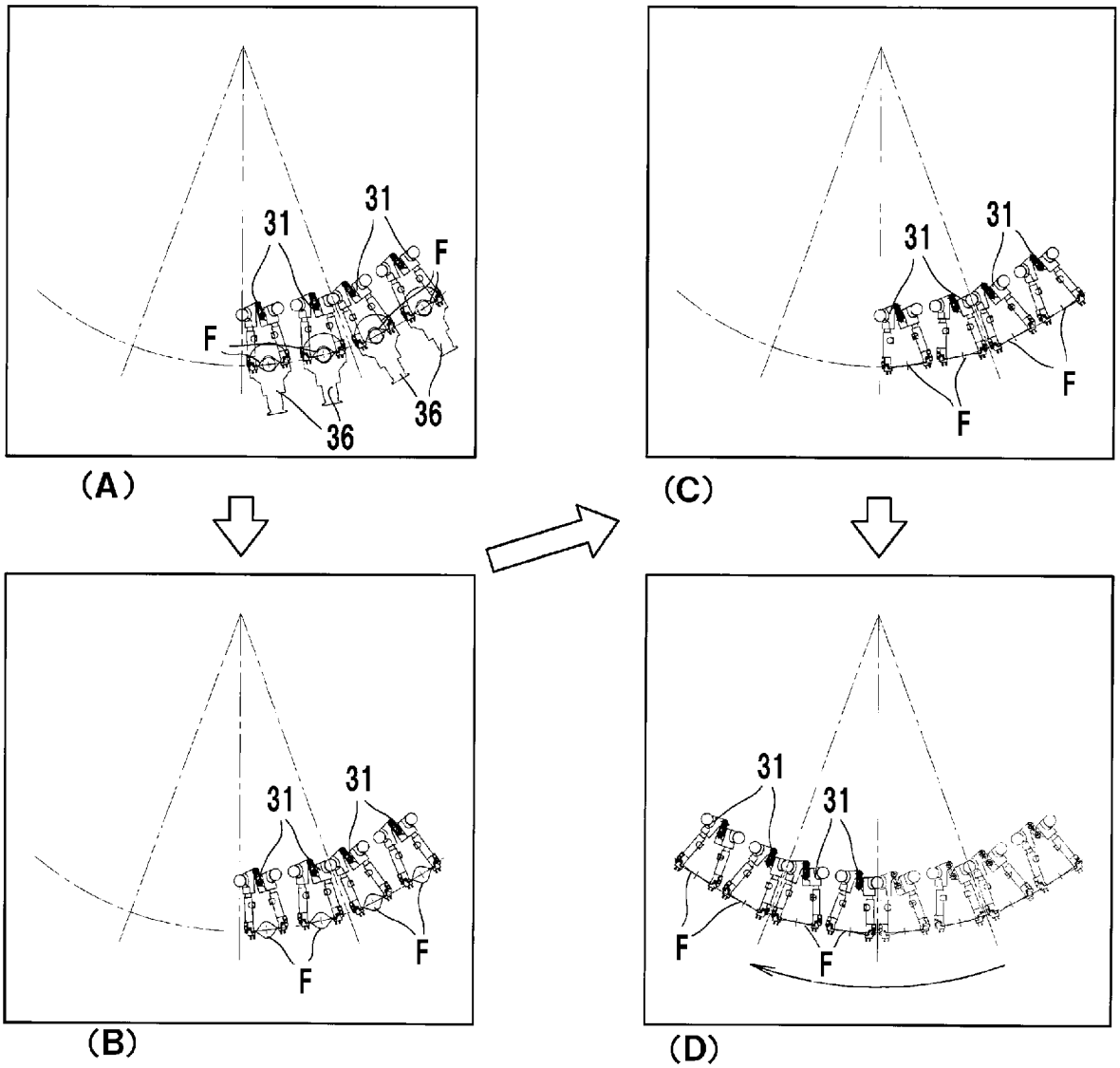
FIGS. 1A to 1D are process charts explaining an example of the packaging method used in the bag-feeding and packaging apparatus in accordance with the invention.
Figure 2:
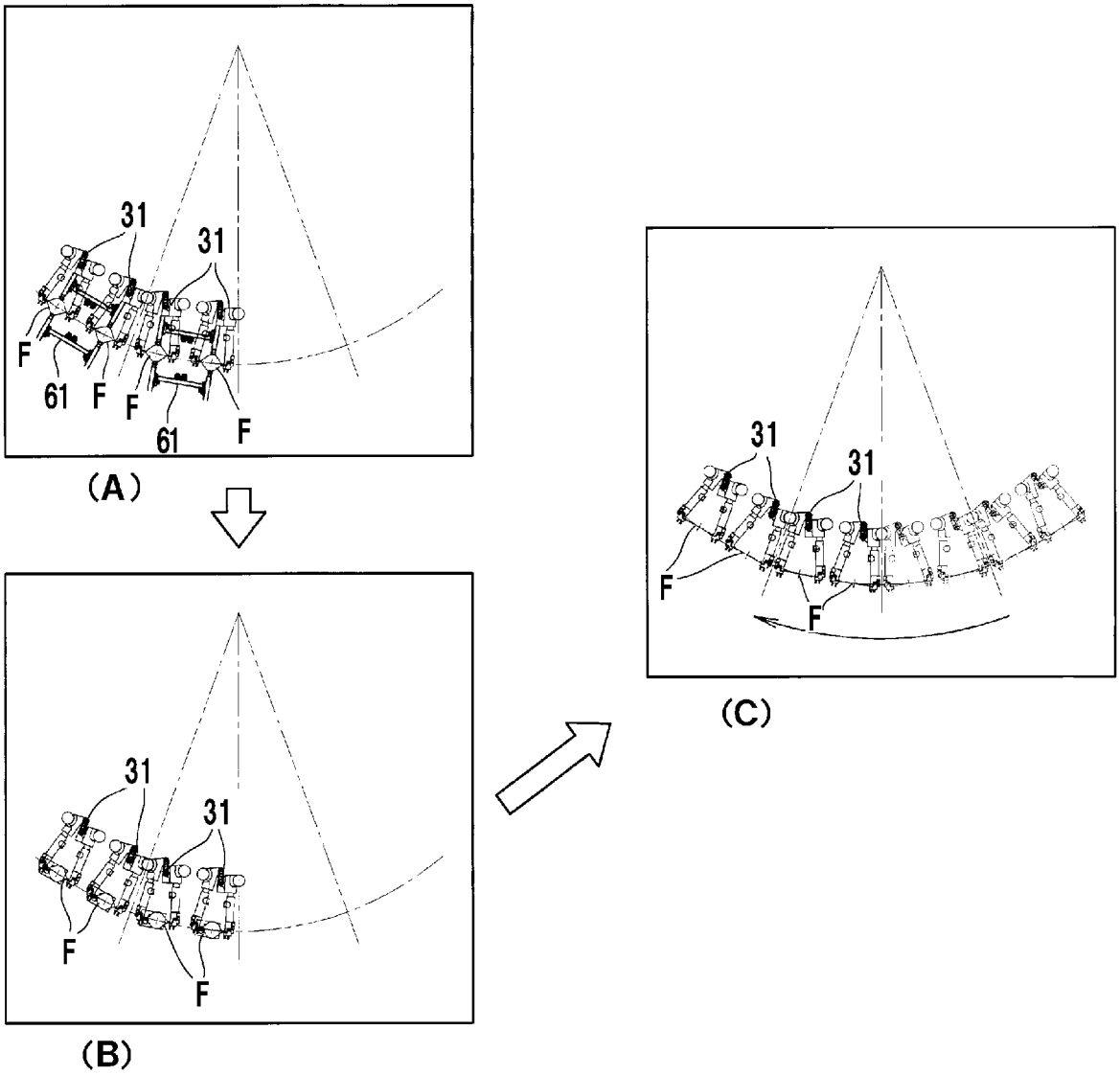
FIGS. 2A to 2C are process charts explaining the packaging method used in the bag-feeding and packaging apparatus as illustrated in FIG. 1.
Figure 3:
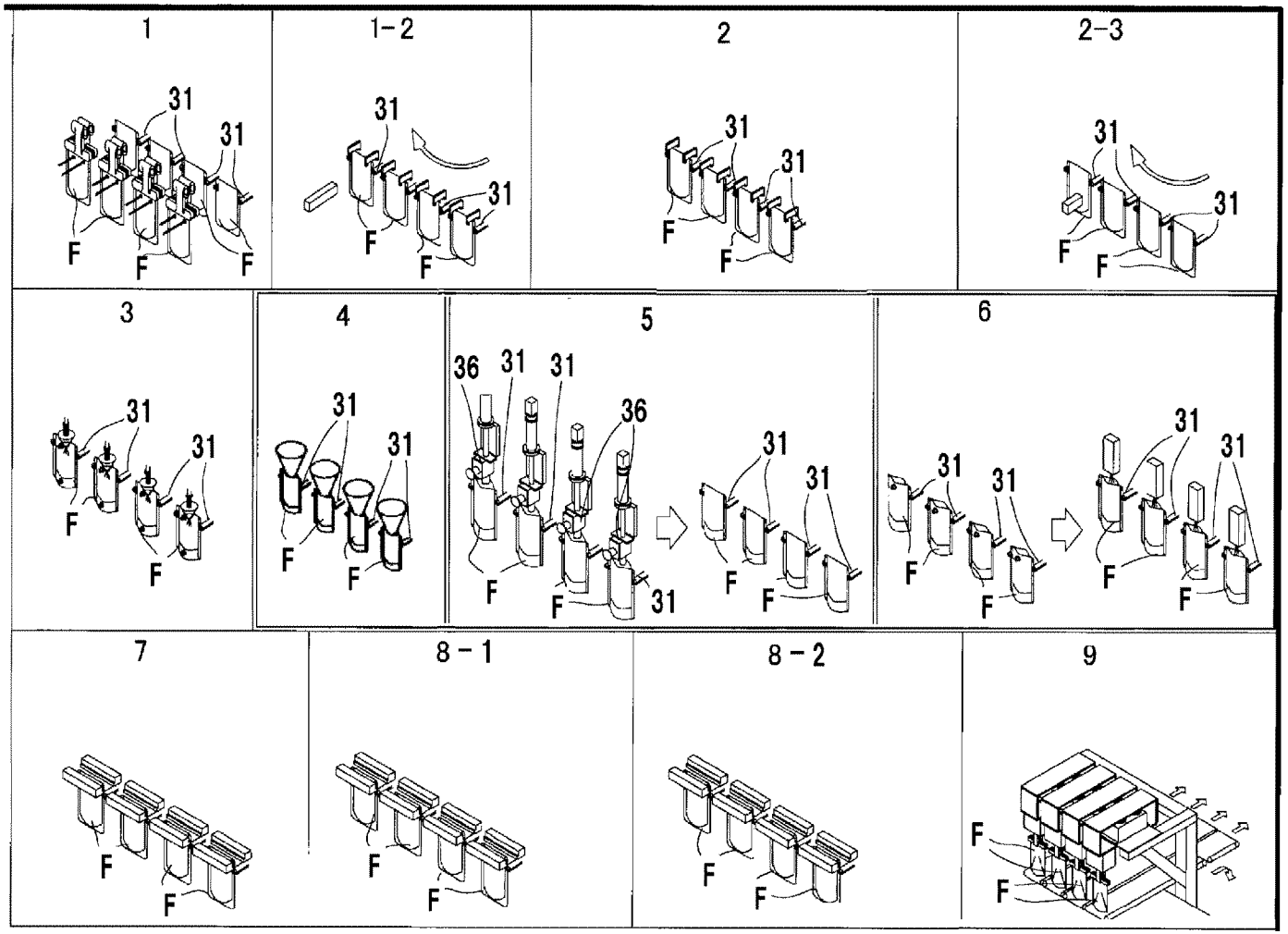
FIG. 3 is an illustration diagram of an example of packaging process in the bag-feeding and packaging apparatus in accordance with the invention.
Figure 4:
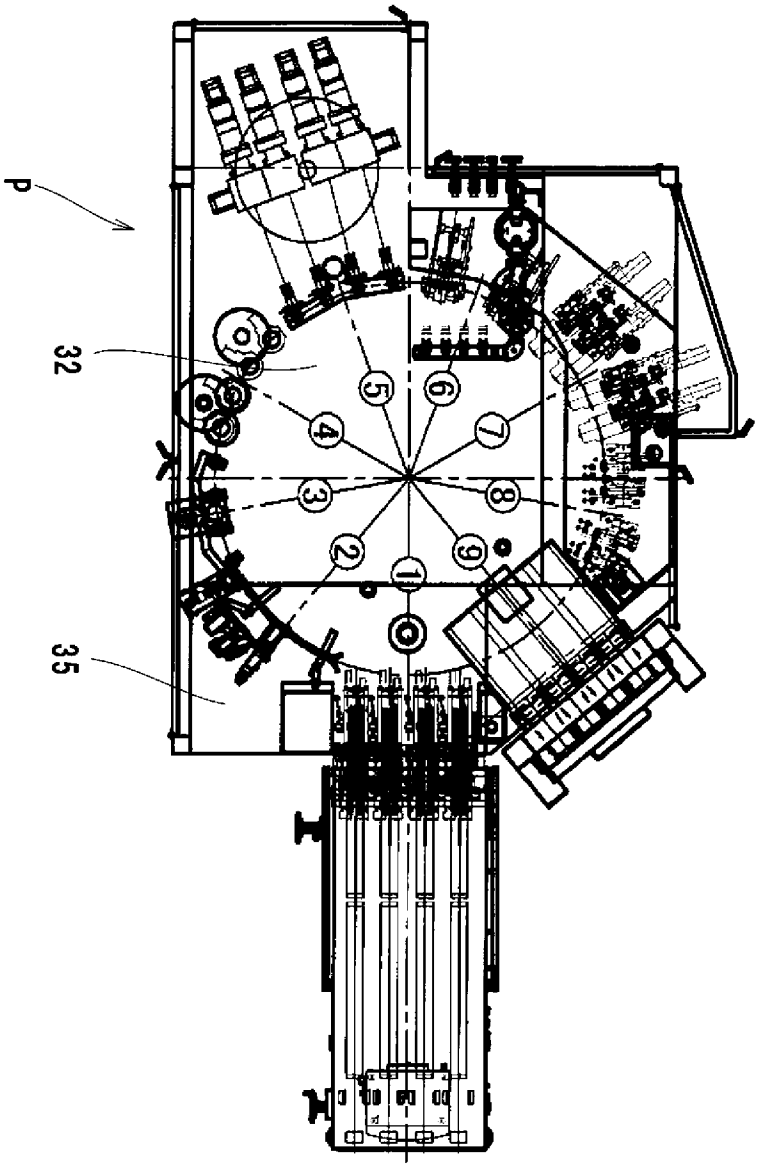
FIG. 4 is a plan view of an example of the bag-feeding and packaging apparatus in accordance with the invention.

The bag-feeding and packaging apparatus P is provided for mass-producing retort food, and four packaging bags F respectively held on the four grip pairs 31 are intermittently moved to the nine stations illustrated in FIG. 4, in the concurrent manner.

Figure 5:
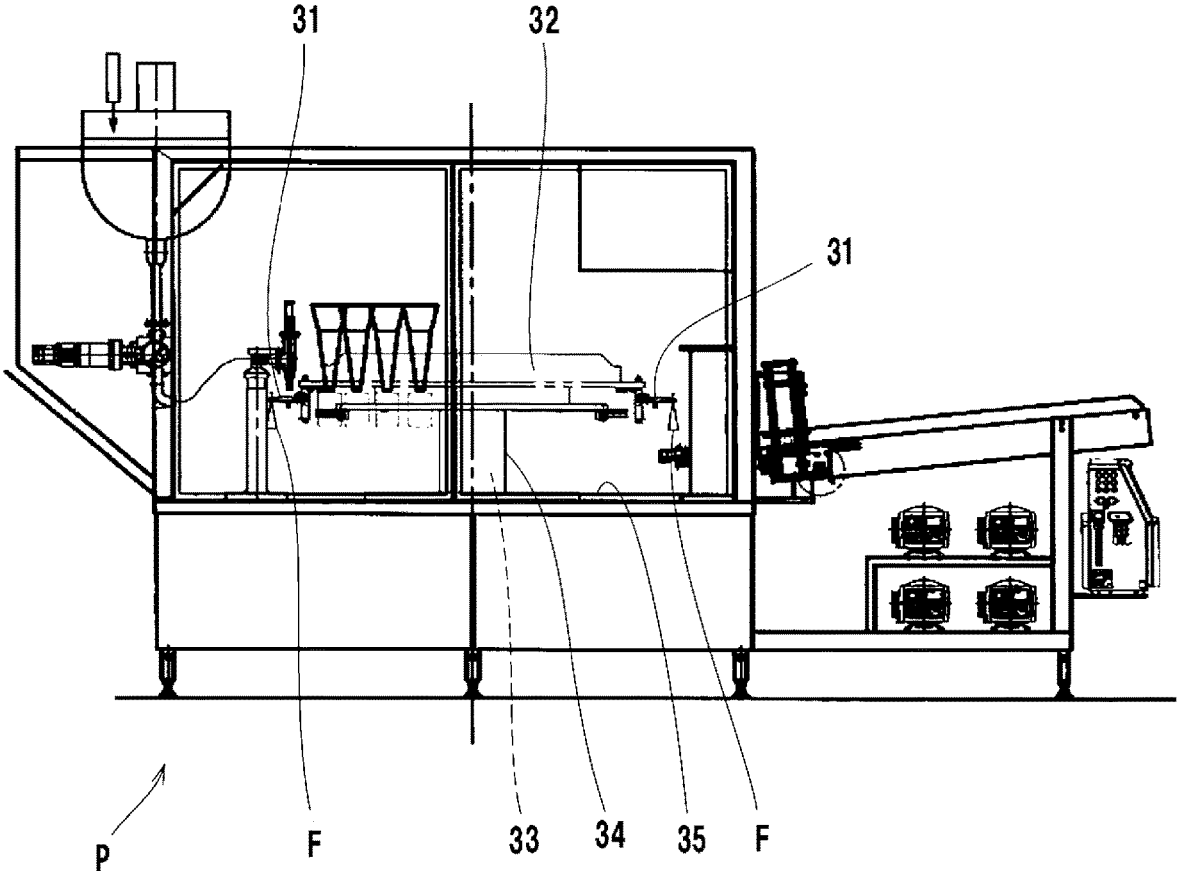
FIG. 5 is a front view of the bag-feeding and packaging apparatus as illustrated in FIG. 4.
Figure 6:
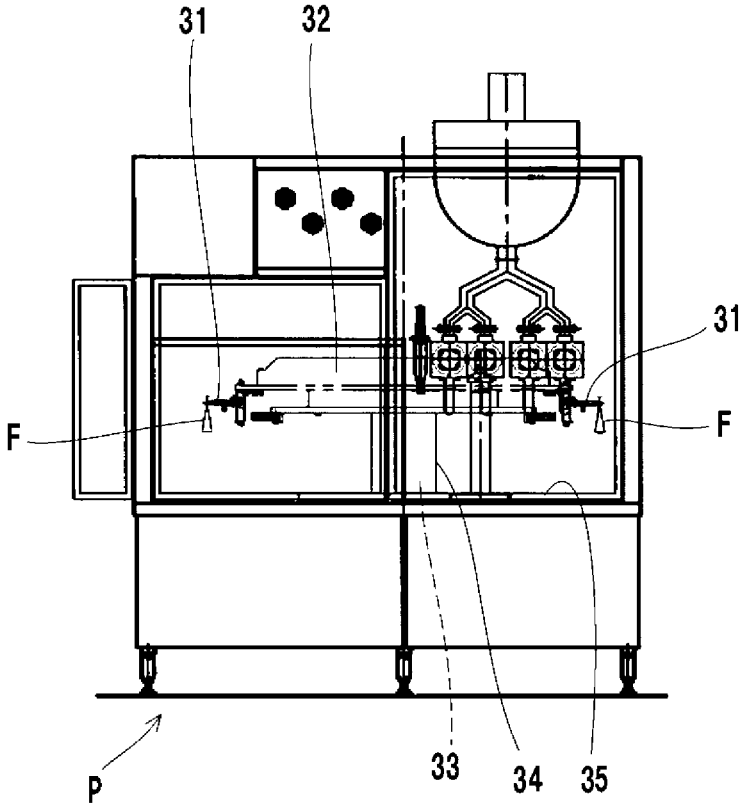
FIG. 6 is a left side view of the bag-feeding and packaging apparatus as illustrated in FIG. 4.
Figure 7:
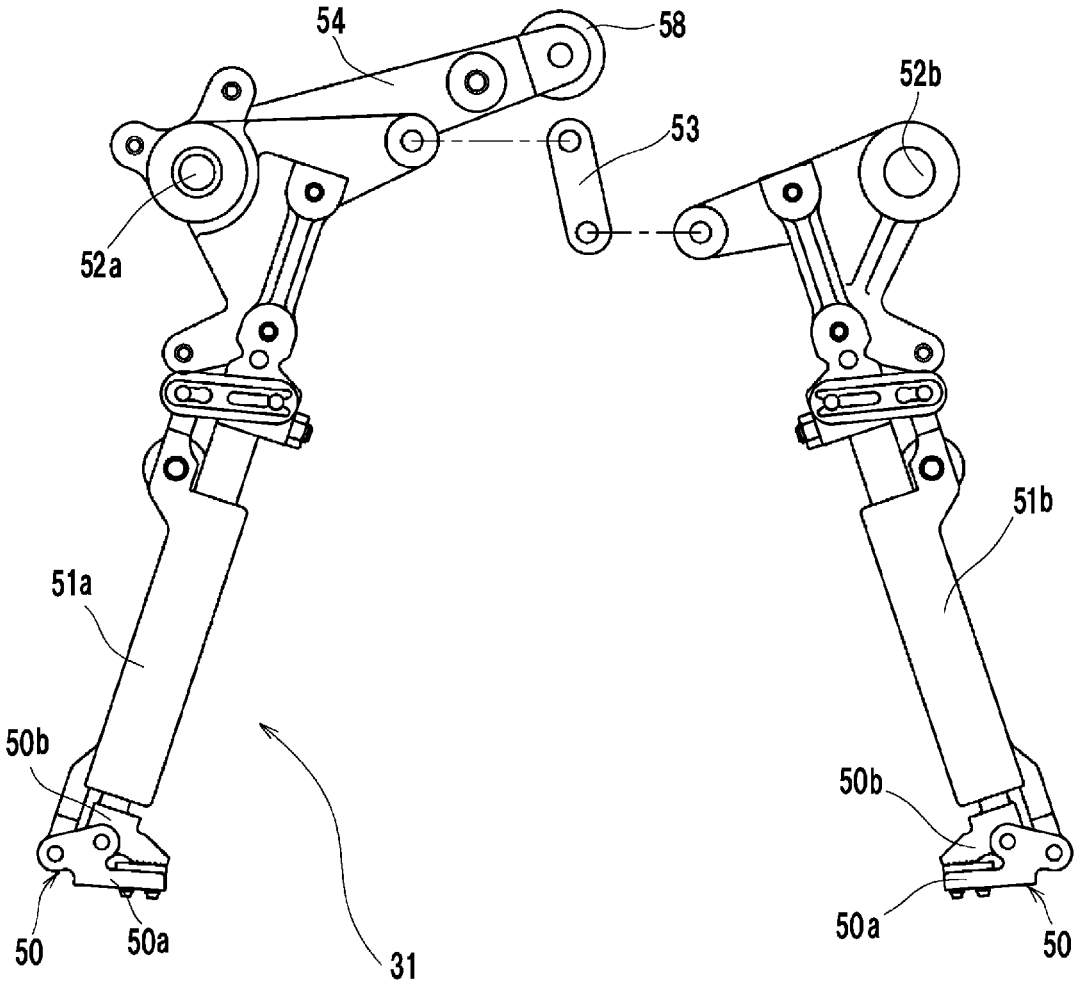
FIG. 7 is a plan view of a grip pair of the bag-feeding and packaging apparatus as illustrated in FIG. 4.

The bag-feeding and packaging apparatus P includes a stand 34 which rotatably supports a vertically extending intermittent rotating shaft 33 and is provided on an apparatus base 35, and the mover (the disk-shaped rotator) 32 which is mounted on an upper part of the intermittent rotating shaft 33 and on which the four grip pairs 31 for gripping or releasing respective packaging bags F are provided so as to project in a radiation direction at equiangular intervals about the intermittent rotating shaft 33, as illustrated in FIG. 5 or 6. These grip pairs 31 are intermittently rotated together with the movers (the disk-shaped rotators) 32 in every packaging process while respectively holding the vicinities of both sides of the bag mouth of each packaging bag F.

Although the embodiment is the rotary type bag-feeding and packaging apparatus in which the mover (the disk-shaped rotator) 32 is intermittently rotated, the present invention should not be limited to this apparatus and can be applied to a known rectilinear movement type (truck type) bag-feeding and packaging apparatus. The rectilinear movement type bag-feeding and packaging apparatus has a known structure in which a number of grip pairs are provided on a mover horizontally moved along an annular pathway comprising a rectilinear part and semicircular parts on both ends of the rectilinear part so that the grip pairs are changeable between a standing posture and a horizontal posture, and a packaging bag fed in a bag feeding process is supported by the grip pairs and intermittently stopped at each of processes such as a mouth opening process, a filling process, a bag mouth sealing process and the like so that the article is packaged.

The bag-feeding and packaging apparatus P has four grip pairs 31 which are intermittently moved to the packaging stations 1 to 9 in the concurrent manner and disposed on the same horizontal level. Grips 50 (36 pairs) of all the grip pairs 31 (4 pairs×9 stations=36 pairs) are configured to be located on a circumference of a circle that is a concentric circle of the mover (the disk-shaped rotator) 32. Thus, the production efficiency and the mass-productivity can be improved since the article is packaged in a large number of packaging bags with four grip pairs 31 in the concurrent manner. Furthermore, since inner and outer arcs on which the grips 50 are located have substantially no difference, the rotary type bag-feeding and packaging apparatus can be rendered smaller in size with the result of a reduction in the area occupied by the rotary type bag-feeding and packaging apparatus. Still furthermore, various devices and/or apparatus disposed at each of the packaging stations 1 to 9 can stably be functioned.

The grip pairs 31 rotated together with the mover (the disk-shaped rotator) 32 may be mounted on the mover (the disk-shaped rotator) 32 in a direct or indirect manner.

Each grip pair 31 has a left holder 51*a* and the grip 50 provided on a distal end of the left holder 51*a*, and a right holder 51*b* and the grip 50 provided on a distal end of the right holder 51*b*, and the left holder 51*a* and the right holder 51*b* are rotatable inside and outside via fulcrums 52*a* and 52*b* respectively provided on proximal end sides.

Proximal end sides of the right and left holders 51*b* and 51*a* are coupled with each other by a link 53 so that both holders are configured to operate simultaneously with each other during adjustment of a grip width. More specifically, as illustrated in FIG. 8, a grip opening-closing lever 54 is fixed to the left holder 51*a*, and an opening-closing plate 57 reciprocable in a radial direction with respect to a grip width adjusting disk 55 is provided in a recess 56 of the grip width adjusting disk 55.

Figure 8:
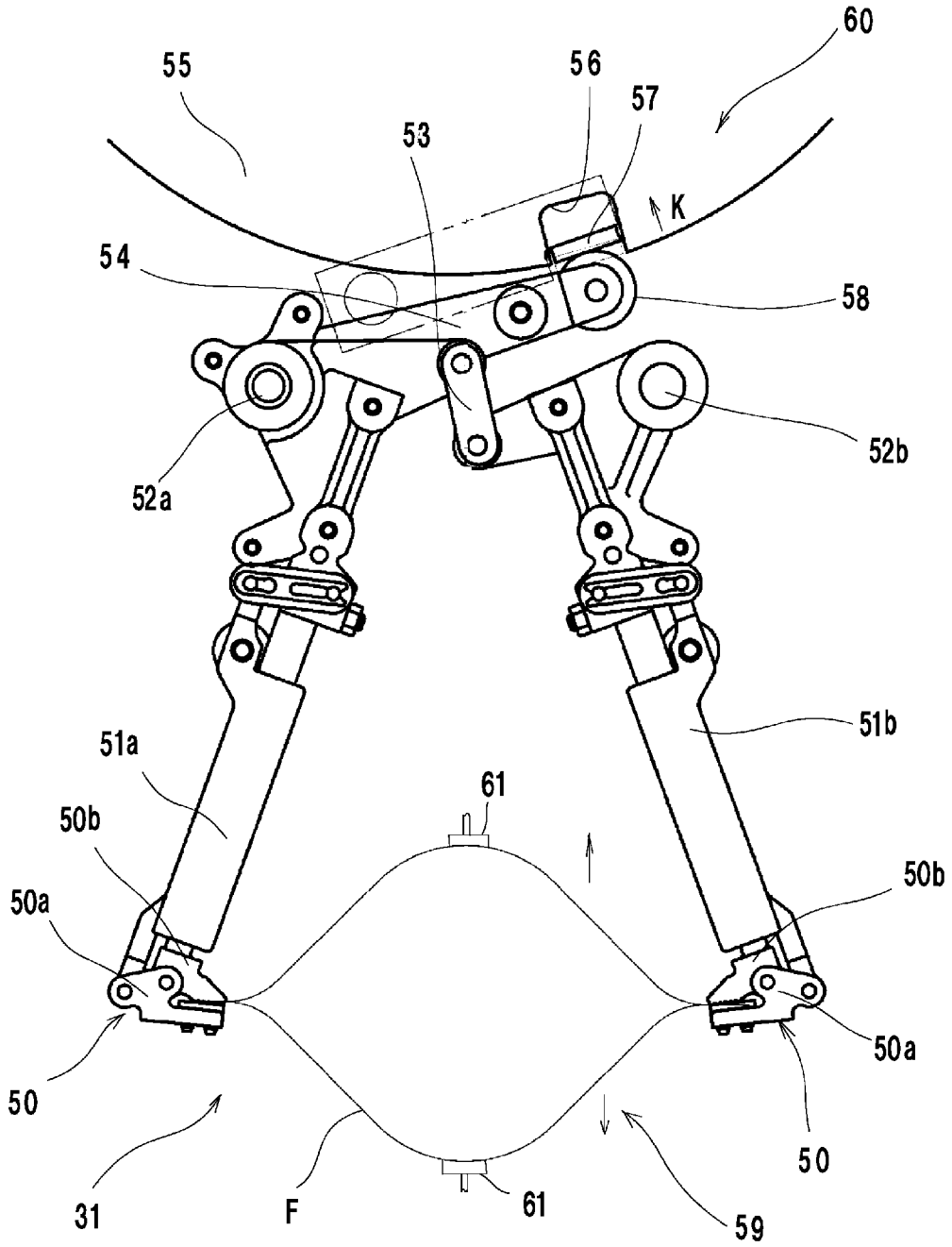
FIG. 8 is a plan view of the grip pair for explaining the operation of the grip pair of the bag-feeding and packaging apparatus as illustrated in FIG. 4.

When the opening-closing plate 57 is moved in a direction of arrow k in FIG. 8 (a direction toward the center of the grip width adjusting disk 55), a grip opening-closing roller 58 mounted on a distal end of the grip opening-closing lever 54 is moved to the grip width adjusting disk 55 side, so that the right and left holders 51*b* and 51*a* are moved inward via the link 53, with the result of reduction in a distance between the grips 50 of the right and left holders 51*b* and 51*a* (a grip width).

Figure 9:
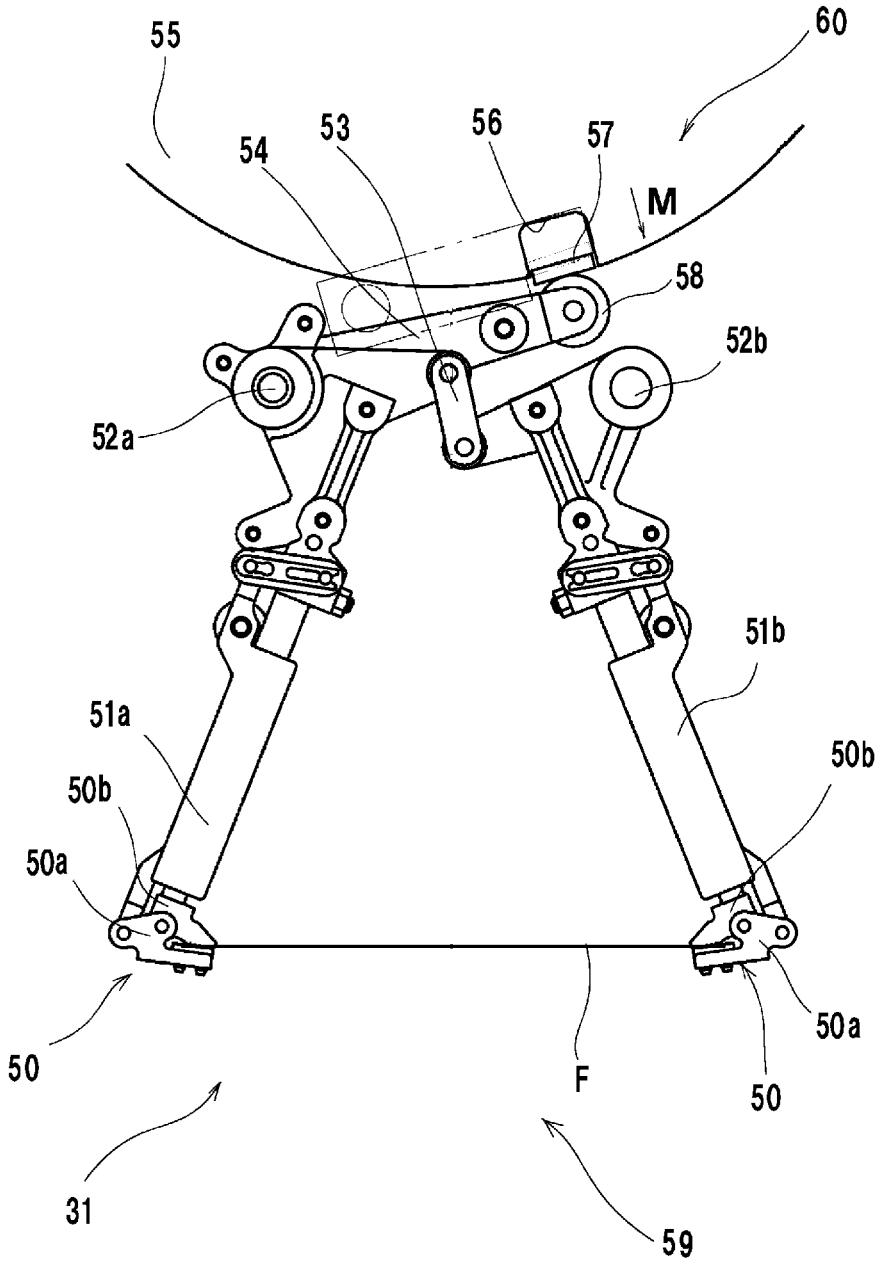
FIG. 9 is also a plan view of the grip pair for explaining the operation of the grip pair of the bag-feeding and packaging apparatus as illustrated in FIG. 4.

On the other hand, when the opening-closing plate 57 is moved in a direction of arrow M in FIG. 9, the grip opening-closing roller 58 mounted on the distal end of the grip opening-closing lever 54 is moved outside the grip width adjusting disk 55, so that the right and left holders 51*b* and 51*a* are moved outward via the link 53, with the result of increase in the distance between the grips 50 of the right and left holders 51*b* and 51*a* (a grip width).

A bag mouth opening-closing mechanism 59 is provided for opening and closing a bag mouth of the packaging bag F and has a grip width adjusting mechanism 60 capable of adjusting the aforementioned width between the grips 50 of the grip pair 31 (the link 53, the grip opening-closing lever 54, the grip width adjusting disk 55, the recess 56, the opening-closing plate 57, the grip opening-closing roller 58, and the bag mouth opening-closing mechanism 59) and a pair of suckers 61 suctioning the packaging bag F held by the grip pairs 31 respectively from the front and back as illustrated in FIG. 8. The bag mouth opening-closing mechanism may be provided with an air injector which injects air through the opened bag mouth to ensure reliable opening.

More specifically, when the bag mouth of the packaging bag F is opened by the bag mouth opening-closing mechanism 59 of the embodiment, the opening-closing plate 57 is moved in the direction of arrow k in FIG. 8 (the direction toward the center of the grip width adjusting disk 55) so that the grip opening-closing roller 58 mounted on the distal end of the grip opening-closing lever 54 is moved to the grip width adjusting disk 55 side, as illustrated in FIG. 8. As a result, the right and left holders 51*b* and 51*a* are moved inward via the link 53 with the result of reduction in the distance between the grips 50 of the right and left holders 51*b* and 51*a* (the grip width). With the movement, the front and back of the packaging bag F are pulled outward with respect to the packaging bag F while being respectively suctioned by the pair of suckers 61, so that the bag mouth of the packaging bag F is opened.

On the other hand, when the bag mouth of the packaging bag F is closed by the bag mouth opening-closing mechanism 59 of the embodiment, while the front and back of the packaging bag F are released from suction by the pair of suckers 61, the opening-closing plate 57 is moved in the direction of arrow M in FIG. 9 so that the grip opening-closing roller 58 mounted on the distal end of the grip opening-closing lever 54 is moved outside the grip width adjusting disk 55, as illustrated in FIG. 9. Thus, the right and left holders 51*b* and 51*a* are moved outward via the link 53 with the result of increase in the distance between the grips 50 of the right and left holders 51*b* and 51*a* (the grip width). With the movement, the bag mouth of the packaging bag F is closed.

The bag-feeding and packaging apparatus P has a bag-feeding station 1, a printing/preheating/bag posture confirmation/seal inspection station 2, a bag bottom blowing/bag opening station 3, an article (a solid) filling station 4, an article (a fluid) filling station 5, a steam deaeration/seal part preheating station 6, a decorative seal applying station 7, an ultrasonic sealing station 8, and an inline check and product discharge station 9. The packaging process (see FIG. 3) executed at each of the stations 1 to 9 will be described.

In the bag-feeding station 1, the packaging bags F sequentially conveyed by a bag-feeding conveyor are sequentially held by the intermittently moved grip pairs 31, so that the bag-feeding process (a first process) is performed. More specifically, in the bag-feeding process (the first process), each packaging bag F, which is moved upward while being maintained in a vertical position by suckers, is held by a holding bar of a bag-feeding device to be transferred to the grip pairs 31 after correction of bag height.

In the printing/preheating/bag posture confirmation/seal inspection station 2, an expiration date or the like is printed by a sealing device on the reverse side of the packaging bag F supported in the vertical position by the grip pairs 31 (performed between stations 1 and 2). Furthermore, the bottom vicinity of the packaging bag F is warmed from both sides of the packaging bag F by a warming device in order that the bottom of the packaging bag F may be opened (preliminary warming), and the position of the packaging bag F is confirmed (bag position confirmation). Still furthermore, a printed part is photographed by a camera in order that printing may be checked to see if it is good or not (seal inspection performed between stations 2 and 3).

In the bag bottom blowing/bag opening station 3, suckers 61 are respectively caused to adhere to two sides of the packaging bag F supported in the vertical position by the grip pairs 31, in order that the bag mouth may be slightly opened, and thereafter, air is supplied into the packaging bag F so that the bag bottom is inflated. More specifically, the bag opening process is performed by the aforementioned bag mouth opening-closing mechanism 59.

In the article (solid) filling station 4, a filling funnel is inserted through the bag mouth so that the packaging bag F is filled with an article (a solid).

In the article (fluid) filling station 5, a filling funnel is inserted through the bag mouth so that the packaging bag F is filled with an article (a fluid).

In the packaging method used in the bag-feeding and packaging apparatus and the bag-feeding and packaging apparatus implementing the packaging method in accordance with the invention, after the article filling process of filling the packaging bag F with the article (the fluid) has been performed in the article (the fluid) filling station 5 where the article filling process is to be performed, the bag mouth of the packaging bag F is closed before the packaging bag F is moved to the subsequent packaging station (the steam deaeration/seal part preheating station) 6. As a result, since the bag mouth of the packaging bag F is closed during the movement, speed-up of the bag-feeding and packaging apparatus P can be realized without the spilling and scattering of the article during the movement and without limitation of the movement acceleration due to the spilling and scattering of the article during the movement, with a result that a larger amount of packaging can be realized in a short time.

More specifically, in the bag-feeding and packaging apparatus of the embodiment, the bag mouth of the packaging bag F is open as illustrated in FIG. 1B after a filling funnel 36 has been inserted through the bag mouth of the packaging bag F held in the vicinities of both ends thereof by the grip pairs 31 as illustrated in FIG. 1A. However, as illustrated in FIG. 1C, the bag mouth opening-closing mechanism 59 is activated to close the bag mouth of the packaging bag F when the packaging bag F is stopped before being moved to the subsequent packaging station (the steam deaeration/seal part preheating station) 6.

In the steam deaeration/seal part preheating station 6, the steam deaeration is performed and thereafter, a seal part is previously heated so that water drops adhered to an inner side of the seal part in the steam deaeration is vaporized thereby to be removed. More specifically, steam is discharged into the packaging bag F from a steam discharge nozzle of a steam deaerator. As a result, air is driven out of the packaging bag F so that a storage period of retort food is improved, and the steam is liquefied so that the volume of inner space is reduced. Subsequently, the seal part of the packaging bag F is clamped by paired pre-heating bars from two sides of the packaging bag F, whereby the water drops adhered to the inner side of the seal part B is vaporized thereby to be removed.

In the packaging method used in the bag-feeding and packaging apparatus and the bag-feeding and packaging apparatus implementing the packaging method in accordance with the invention, the bag mouth of the packaging bag F is closed after execution of the aforementioned steam deaeration in the steam deaeration/seal part preheating station 6 before the packaging bag F is moved to the subsequent packaging station (a the decorative seal applying station 7). As a result, even in the case where a packaging station located downstream of the article filling station has a packaging station requiring opening of the bag mouth of the packaging bag, the speed-up of the bag-feeding and packaging apparatus can be realized without limitation of the movement acceleration due to the spilling and/or scattering of the article during the movement, with the result that a large amount of packaging can be realized in a short time.

More specifically, in the bag-feeding and packaging apparatus P, after the bag mouth of the packaging bag F has been opened by the bag mouth opening-closing mechanism 59 as illustrated in FIG. 2A, the steam deaeration is performed as illustrated in FIG. 2B, and the bag mouth opening-closing mechanism 59 is activated to close the bag mouth of the packaging bag F when the packaging bag F is stopped before being moved to the subsequent packaging station (the decorative seal applying station) 7, as illustrated in FIG. 2C.

In the bag-feeding and packaging apparatus P of the embodiment, the steam deaeration process serves as the packaging process requiring opening of the bag mouth of the packaging bag F in the packaging station located downstream of the article filling station 5. However, the packaging process requiring opening of the bag mouth of the packaging bag F should not be limited to the steam deaeration process, and the packaging process requiring opening of the bag mouth of the packaging bag F may broadly include any packaging process requiring opening of the bag mouth of the packaging bag F, for example, a powder blowoff process of blowing off powder adherent to an inner surface of the bag mouth in the case where the article is powder. Furthermore, the packaging process requiring opening of the bag mouth of the packaging bag F should not be limited to the subsequent process of the article filling process but may broadly include any packaging process performed after the article filling process.

Thus, when the opening requiring process requiring opening of the bag mouth of the packaging bag F is performed in the packaging station downstream of the article filling station, the packaging process requiring opening of the bag mouth of the packaging bag F is preferably performed in the packaging station where the opening requiring process is to be performed, after opening of the bag mouth of the packaging bag F by the bag mouth opening-closing mechanism 59, and the bag mouth of the packaging bag F is preferably closed before the packaging bag F is moved to the subsequent packaging station.

In the bag-feeding and packaging apparatus P of the embodiment, furthermore, the bag mouth of the packaging bag F is closed after the filling of the packaging bag F with the article (the fluid) in the article (the fluid) filling station 5 where the article filling process is performed. The packaging bag F is moved from the article (the solid) filling station 4 to the subsequent packaging station (the article (the fluid) filling station 5 with the bag mouth of the packaging bag F being open after the packaging bag F has been filled with the article. However, the scope of the present invention encompasses closing the bag mouth of the packaging bag F after the filling of the packaging bag F with the article (the solid) in the article (solid) filling station 4 when the article (the solid) scatters depending on the degree of high-speed movement. Still furthermore, since the bag-feeding and packaging apparatus P of the embodiment mass-produces packaged retort food, the article should not be limited to fluids and solids. The scope of the present invention involves applying to a bag-feeding and packaging apparatus for packaging powder, granule or the like.

In the decorative seal applying station 7, an upper part of the seal part of the packaging bag F is clamped by paired sealing bars from both sides of the packaging bag F with the result that a decorative seal (cosmetic seal) D is applied to the packaging bag F. By applying the decorative seal prior to the ultrasonic seal, water droplets that could not be removed by the preheating of the seal part are allowed to escape to the upper and lower sides (inside and outside of the packaging bag F), and large bubbles can be prevented from remaining on the inside of the seal and wrinkles can be prevented from occurring in the seal part.

In the ultrasonic sealing station 8, a sealing horn of an ultrasonic sealer is pressed against a lower part of the seal part of the packaging bag F so that the ultrasonic seal C is applied to the packaging bag F (process 8-1) with the result that the packaging bag F is completely sealed. Subsequently, as illustrated in FIG. 8, the seal part of the packaging bag F is held between paired cooling bars from the outside and inside of the packaging bag F so that fine bubbles generated on the decorative seal D are removed by the cooling bars, whereby perforations are formed (seal cooling process 8-2).

In the inline check/product discharge station 9, the weight of the packaging bag F in which the article is packaged is measured, and the packaging bag F in which a suitable amount of article is packaged is discharged via a sorting chute to an external conveyor. The bag-feeding and packaging apparatus is configured so that the aforementioned sequential packaging process is performed for the packaging bags F supported by the grip pairs 31 intermittently moved by the intermittent rotation of the mover 32 thereby to mass-produce packaged products of articles (retort food).

The packaging method used in the bag-feeding and packaging apparatus and the bag-feeding packaging apparatus of another embodiment in accordance with the present invention will be described with reference to FIG. 10. The article filling station in the embodiment is configured so that the article filling process and the steam deaeration process of introducing steam through the bag mouth of the packaging bag F to deaerate the packaging bag are performed therein. Thus, a packaging station where steam deaeration is performed can be removed with the result of a space-saving compact packaging apparatus.

The article filling station in this embodiment is configured so that the article filling process and the steam deaeration process are concurrently performed therein. More specifically, the filling funnel 36 is inserted through the bag mouth of the packaging bag F held at the vicinities of both ends by the grip pairs 31 so that the packaging bag F is filled with the article, as illustrated in FIG. 10A, and concurrently with this, the steam deaeration is performed as illustrated in FIG. 10B. Upon completion of the article filling process and the steam deaeration, the bag mouth of the packaging bag F is open as illustrated in FIG. 10C. However, the bag mouth opening-closing mechanism is activated to close the bag mouth of the packaging bag F during stop of the packaging bag F before the movement thereof to the subsequent packaging station as illustrated in FIG. 10D, and thereafter, the packaging bag F is moved to the subsequent packaging station (FIG. 10E).

Figure 10:
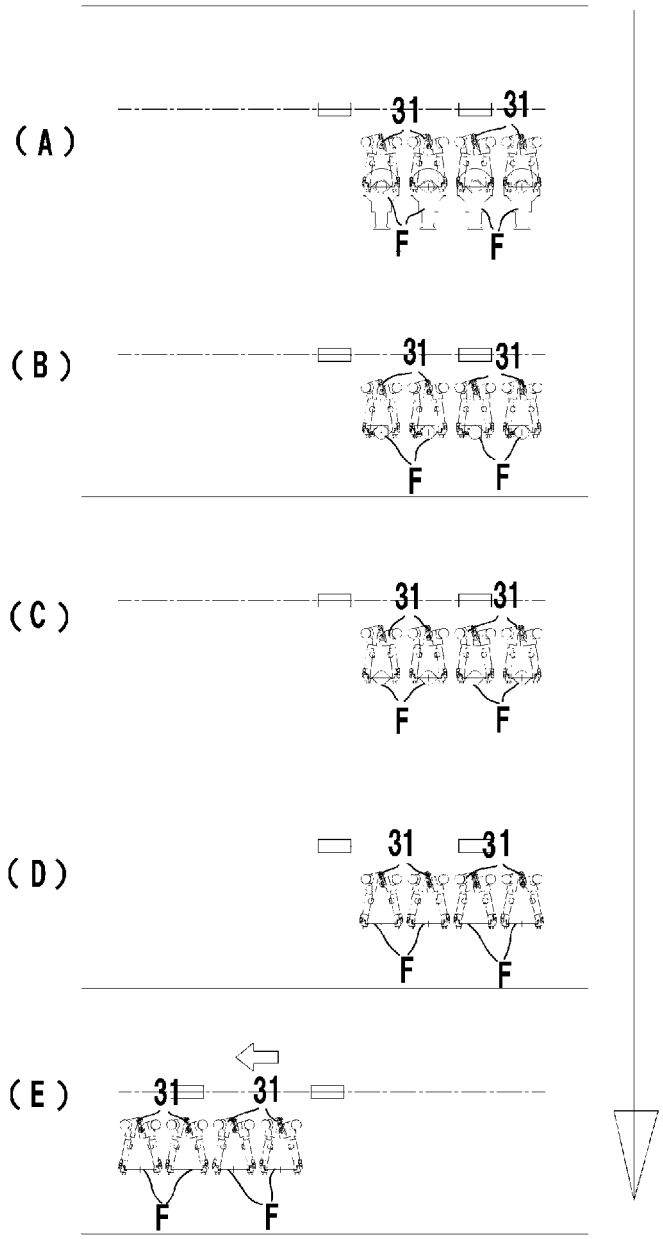
FIGS. 10A to 10E are illustration diagrams for explaining another example of the bag-feeding and packaging apparatus in accordance with the invention.
Figure 11:
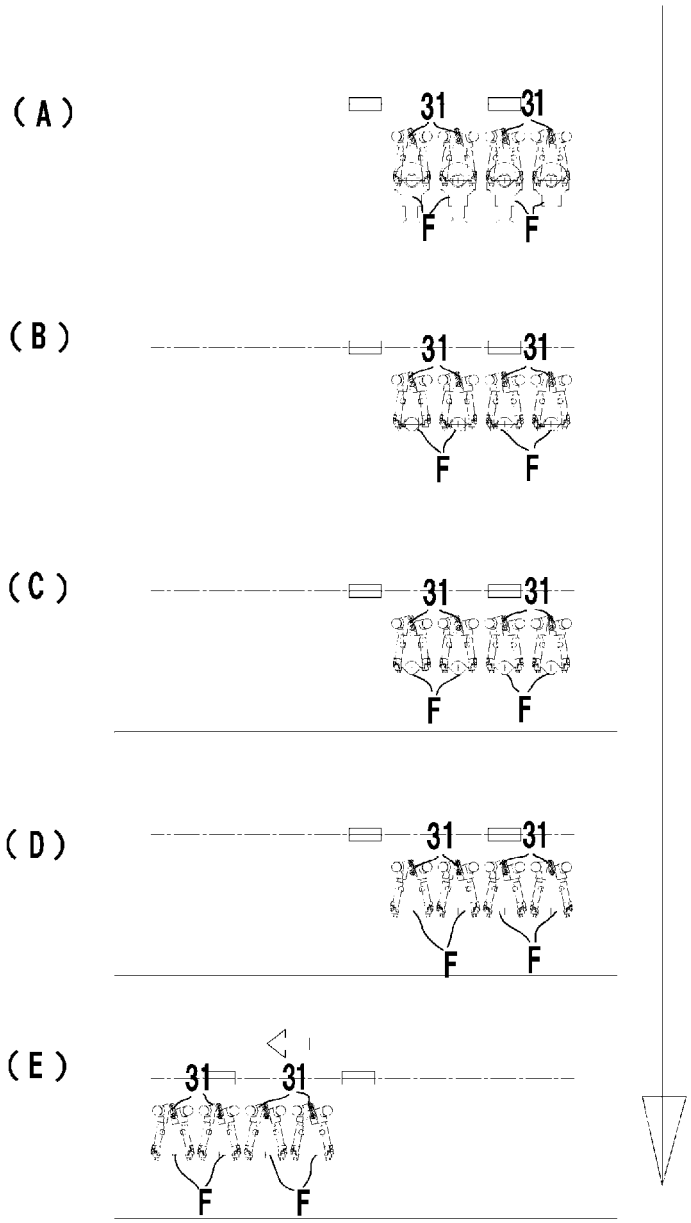
FIGS. 11A to 11E are illustration diagrams for explaining further another example of the bag-feeding and packaging apparatus in accordance with the invention.
Figure 12:
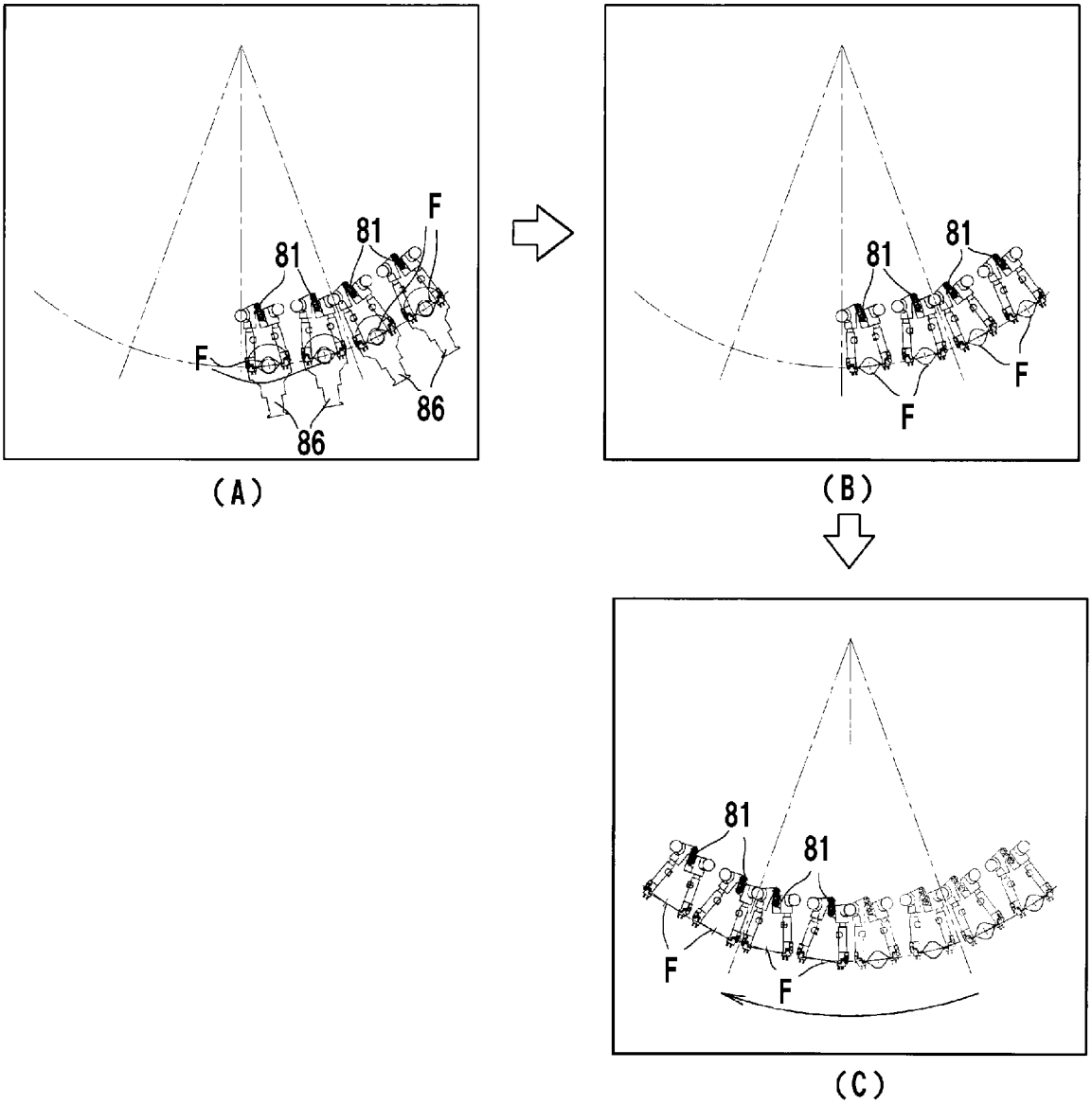
FIGS. 12A to 12C are process charts explaining a packaging method used in a conventional bag-feeding and packaging apparatus.
Figure 13:
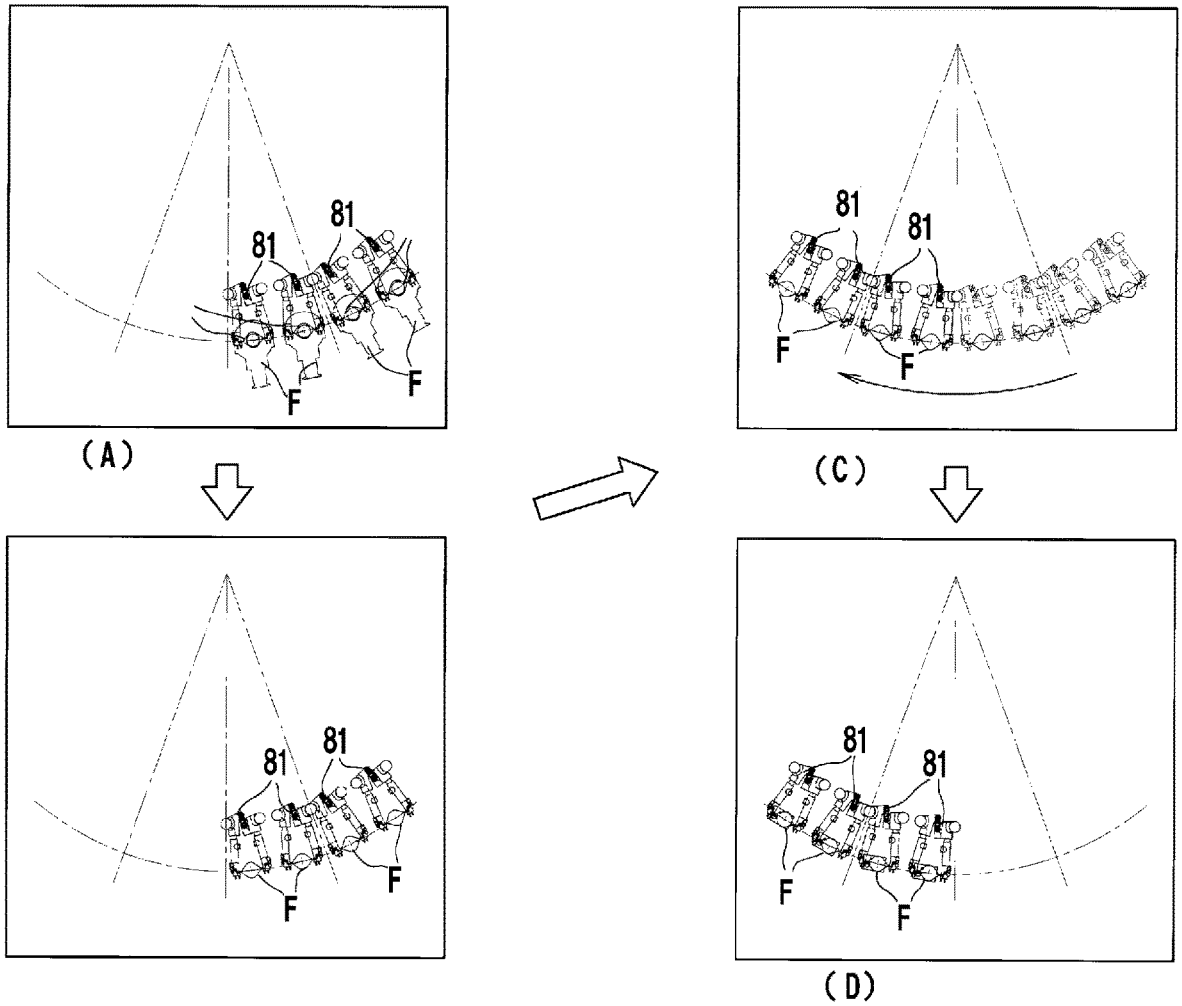
FIG.13 PRIOR ART
FIGS. 13A to 13D are process charts explaining a packaging method used in a conventional bag-feeding and packaging apparatus.
Figure 14:
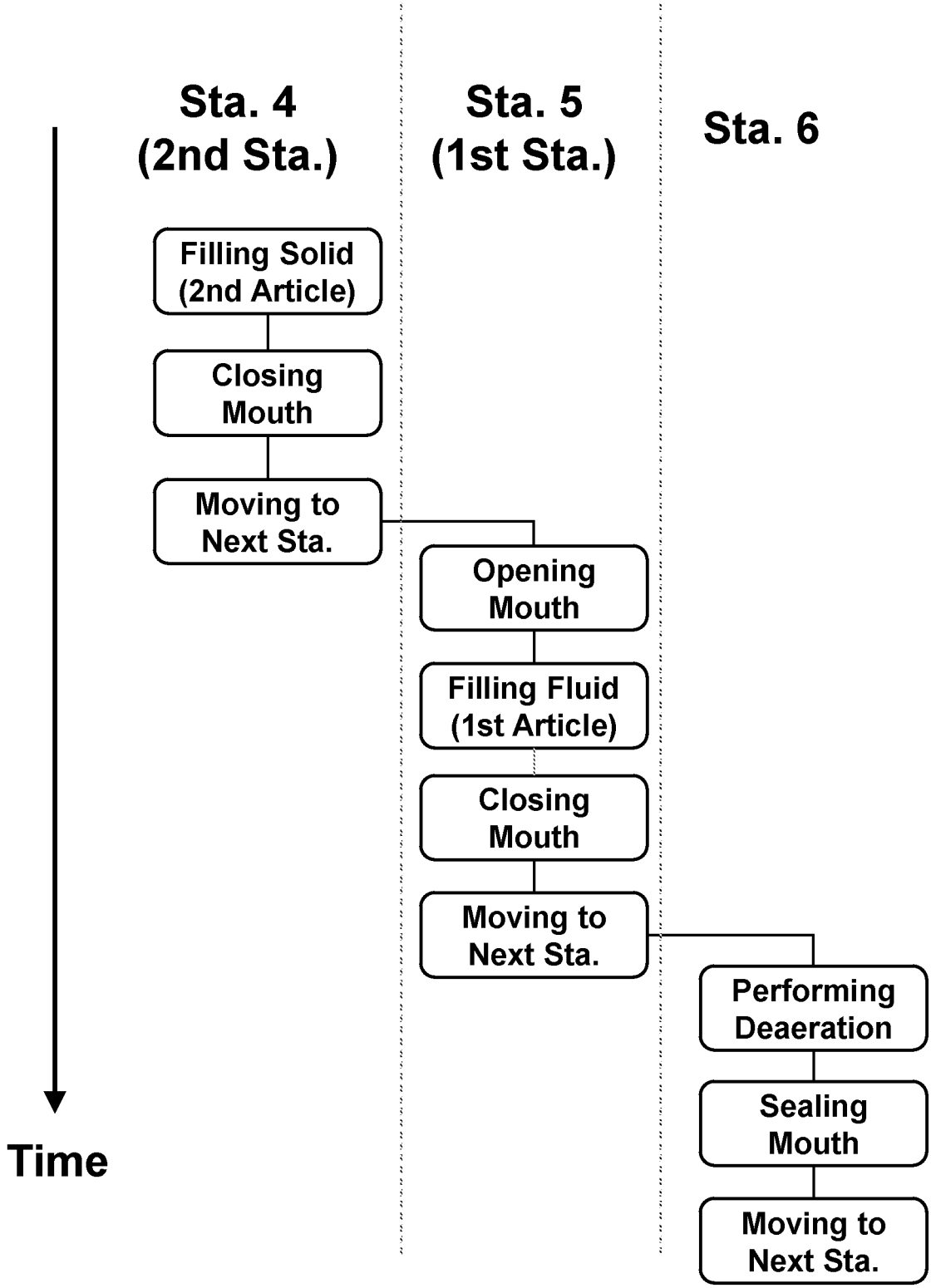
FIG. 14 is a flowchart in which several processes, which are performed at article filling station 4 (or the second station), article filling station 5 (or the first station) and steam deaeration/seal part preheating station 6, are illustrated.

In the packaging method used in the bag-feeding and packaging apparatus and the bag-feeding and packaging apparatus in accordance with further another embodiment of the invention as illustrated in FIG. 11, the article filling process and the steam deaeration process are concurrently performed in the article filling station in the same manner as in the embodiment illustrated in FIG. 10. However, this embodiment differs from the embodiment as illustrated in FIG. 10 in that the steam deaeration process is performed after execution of the article filling process in the article filling station.

More specifically, the filling funnel 36 is inserted through the bag mouth F held at the vicinities of both ends by the grip pairs 31 so that the packaging bag F is filled with the article, as illustrated in FIG. 11A, and the steam deaeration process is thereafter performed as illustrated in FIG. 11B. Upon completion of the article filling process and the steam deaeration process, the bag mouth of the packaging bag F is closed as illustrated in FIG. 11C. However, the bag mouth opening-closing mechanism is activated to close the bag mouth of the packaging bag F during stop of the packaging bag F before the movement thereof to the subsequent packaging station as illustrated in FIG. 11D, and the packaging bag F is thereafter moved to the subsequent packaging station (FIG. 11E). The packaging method used in the bag feeding and packaging apparatus and the bag feeding and packaging apparatus in accordance with the invention encompass the above-described embodiment.

EXPLANATION OF REFERENCE SYMBOLS

P bag-feeding and packaging apparatus
1 bag-feeding station
2 printing/preheating/bag posture confirmation/seal inspection station
3 bag bottom blowing/bag opening station
4 article (solid) filling station
5 article (fluid) filling station
6 steam deaeration/seal part preheating station
7 decorative seal applying station
8 ultrasonic sealing/empty bag discharge station
9 inline check/product discharge station
31 grip pair
32 mover (disk-shaped rotator)
33 intermittent rotating shaft
34 stand
35 apparatus base
36 filling funnel
50 grip
50*a* holding grip
50*b* fixed grip
51*a* left holder
51*b* right holder
52*a* fulcrum
52*b* fulcrum
53 link
54 grip opening-closing lever
55 grip width adjusting disk
56 recess
57 opening-closing plate
58 grip opening-closing roller
59 bag mouth opening-closing mechanism
60 grip width adjusting mechanism
61 sucker
F packaging bag

The invention claimed is:

1. A packaging method used in a bag-feeding and packaging apparatus which performs packaging processes while intermittently moving a packaging bag to packaging stations together with a mover in a moving direction, thereby packaging an article, the packaging method comprising:

filling the packaging bag with the article at an article filling station which is defined as an article filling process; and closing a bag mouth of the packaging bag before movement of the packaging bag to a subsequent packaging station from the article filling station in the moving direction after the article filling process has been performed, the article filling station being one of the packaging stations; wherein the article is a first article, the article filling station is a first article filling station and the article filling process is a first article filling process, and the packaging method further comprises filling the packaging bag with a second article, which is different from the first article, at a second article filling station, which is located upstream of the first article filling station in the moving direction, wherein the process of filling the second article is defined as a second article filling process, and closing the bag mouth of the packaging bag before movement of the packaging bag to the first article filling station from the second article filling station in the moving direction after the second article filling process has been performed.

2. The packaging method according to claim 1, further comprising:

moving the packaging bag of which the bag month has been closed in the article filling station to the subsequent packaging station, which is located downstream of the article filling station in the moving direction, opening the bag mouth of the packaging bag, which is defined as a packaging process requiring opening of the bag mouth of the packaging bag, and closing the bag mouth of the packaging bag after the packaging process requiring opening of the bag mouth of the packaging bag is performed the subsequent packaging station before movement of the packaging bag to another subsequent packaging station, which is located downstream of the subsequent packaging station in the moving direction.

3. The packaging method according to claim 2, wherein the packaging process requiring opening of the bag mouth of the packaging bag is a steam deaeration process of introducing steam through the bag mouth of the packaging bag to deaerate the packaging bag.

4. The packaging method according to claim 2, wherein the subsequent packaging station is located adjacently next to the article filling station such that no packaging station intervenes between the subsequent packaging station and the article filling station, and the another subsequent packaging station is located adjacently next to the subsequent packaging station such that no packaging station intervenes between the another subsequent packaging station and the subsequent packaging station.

5. The packaging method according to claim 1, further comprising:

introducing steam through the bag mouth of the packaging bag to deaerate the packaging bag in the article filling station, which is defined as a steam deaeration process.

6. The packaging method according to claim 5, wherein the article filling process is performed prior to the steam deaeration process.

7. The packaging method according to claim 5, wherein the steam deaeration process is performed in the article filling station after execution of the article filling process.

8. A bag-feeding and packaging apparatus which performs packaging processes while intermittently moving a packaging bag to packaging stations together with a mover in a moving direction, thereby packaging an article, the bag-feeding and packaging apparatus comprising:

a bag mouth opening-closing mechanism configured to open and close a bag mouth of the packaging bag, and an article filling station in which an article filling process is performed such that the article is placed inside the packaging bag through the bag mouth, which is opened by the bag mouth opening-closing mechanism, wherein the bag mouth opening-closing mechanism is configured to close the bag mouth of the packaging bag in the article filling station before movement of the packaging bag to a subsequent packaging station from the article filling station in the moving direction after the article filling process has been performed, the article filling station being included in the packaging stations, the article is a first article, the article filling station is a first article filling station and the article filling process is a first article filling process, the bag-feeding packaging apparatus further comprise a second article filling station in which a second article filling process is performed such that a second article, which is different from the first article, is placed inside the packaging bag through the bag mouth, which is opened by the bag mouth opening-closing mechanism, wherein the second article filling station is located upstream of the first article filing station in the moving direction, and the bag mouth opening-closing mechanism is configured to close the bag mouth of the packaging bag in the second article filling station before movement of the packaging bag to the first packaging station from the second article filling station in the moving direction after the second article filling process has been performed.

9. The bag-feeding and packaging apparatus according to claim 8, wherein the bag-feeding and packaging apparatus is configured to perform a packaging process requiring opening of the bag mouth of the packaging bag in the subsequent packaging station located downstream of the article filling station, and the bag mouth opening-closing mechanism is configured to open and close the bag mouth of the packaging bag during the packaging process requiring opening of the bag mouth of the packaging bag performed in the subsequent packaging station before movement of the packaging bag to another subsequent packaging station located downstream of the subsequent packaging station.

10. The bag-feeding packaging apparatus according to claim 9, wherein the packaging process requiring opening of the bag mouth of the packaging bag is a steam deaeration process of introducing steam through the bag mouth of the packaging bag to deaerate the packaging bag.

11. The bag-feeding packaging apparatus according to claim 9, wherein the subsequent packaging station is located adjacently next to the article filling station such that no packaging station intervenes between the subsequent packaging station and the article filling station, and the another subsequent packaging station is located adjacently next to the subsequent packaging station such that no packaging station intervenes between the another subsequent packaging station and the subsequent packaging station.

12. The bag-feeding packaging apparatus according to claim 8, wherein the bag-feeding packaging apparatus is further configured to perform a steam deaeration process of introducing steam through the bag mouth of the packaging bag to deaerate the packaging bag in the article filling station.

13. The bag-feeding packaging apparatus according to claim 12, wherein the bag-feeding packaging apparatus is configured to perform the article filling process in the article filling station and prior to the steam deaeration process.

14. The bag-feeding packaging apparatus according to claim 12, wherein the steam deaeration process is performed in the article filling station after execution of the article filling process.

15. The bag-feeding packaging apparatus according to claim 8, further comprising:

a pair of grips that are intermittently moved to the packaging stations together with the mover while holding vicinities of both sides of the bag mouth of the packaging bag.

16. The bag-feeding packaging apparatus according to claim 15, wherein the bag mouth opening-closing mechanism has a grip width adjusting mechanism that is configured to adjust a width between the grips and suckers that suck the packaging bag held by the grips respectively from a front and a back of the packaging bag.

17. The bag-feeding packaging apparatus according to claim 15, wherein the grip width adjusting mechanism narrows the grip width by getting the grips closer to open the bag mouth of the packaging bag, and the grip width adjusting mechanism broadens the grip width by getting the grips wider to close the bag mouth of the packaging bag.

* * * * *